US006256803B1

(12) United States Patent
Sauerbrei et al.

(10) Patent No.: US 6,256,803 B1
(45) Date of Patent: Jul. 10, 2001

(54) BABY CHANGING AND WASHING STATION

(76) Inventors: Roxanne Sauerbrei, PCS 556 Box 527, Okinawa FPO AP; Sasha Orihuela Dorsey, PSC 559 Box 6138, FPO AP 96377-6138, both of (JP)

( * ) Notice: Subject to any disclaimer, the term of this patent is extended or adjusted under 35 U.S.C. 154(b) by 0 days.

(21) Appl. No.: 09/499,133

(22) Filed: Feb. 7, 2000

(51) Int. Cl.[7] ..... A47K 3/26

(52) U.S. Cl. ..... 4/443; 4/621; 4/625; 4/643; 5/655

(58) Field of Search ..... 4/443, 446, 572.1, 4/621, 625, 638, 643, 644, 650, 659; 5/655, 947

(56) References Cited

U.S. PATENT DOCUMENTS 877,770 * 1/1908 Hines et al. ..... 4/644 X
1,442,391 * 1/1923 Filipache ..... 4/572.1 X
2,719,306 * 10/1955 Levitt ..... 4/572.1 X
3,319,265 * 5/1967 Losada ..... 4/572.1
4,689,841 * 9/1987 Owen ..... 4/644

* cited by examiner

*Primary Examiner*—Robert M. Fetsuga
(74) *Attorney, Agent, or Firm*—John D. Gugliotta; Michael J. Corrigan

(57) ABSTRACT

A baby changing and washing station is disclosed, designed as an apparatus to aid in the washing and/or cleansing of an infant. The present invention comprises a frame that is attached to a wall and provides for a fold down table portion, similar in design to a conventional diaper changing station. A padded vinyl area for the infant is provided along with restraining straps to hold the infant. A water bottle is provided in a heated container to allow the water to be slightly warmed. Tubing is designed to carry the water through a release device at the end of the tube to allow cleansing of the infant after a diaper change or may be used to wash the entire infant. A drain system in the fold down table collects the waste water in a catch basin which may be removed and emptied after bathing duties are complete.

4 Claims, 6 Drawing Sheets

BABY CHANGING AND WASHING STATION

RELATED APPLICATIONS AND DISCLOSURES

The present invention was first disclosed in the Disclosure Document filed on Jun. 7, 1999. There have been no previously filed, nor any co-pending applications, anywhere in the world.

BACKGROUND OF THE INVENTION

1. Field of the Invention

The present invention relates generally to baby cleaning devices, and, more particularly, to a baby changing and washing station.

2. Description of the Related Art

There are many different appliances to aid in the care and cleaning of an infant, all of which perform a certain function. A diaper changing table is often found in households in which an infant is present. The changing table provides a work surface that is relatively high and thus easy for the care giver to perform the diaper changing task.

Bathtubs are often used to bathe infants. However, most bathtubs are located at floor level. This obviously presents a situation where the back muscles of the care giver can easily become strained.

A related situation occurs when changing an infant's diapers. While tissues and baby wipes are available to assist in the cleaning duties, particularly messy diapers often require heavy duty cleaning.

Many times, placing the infant in a bathtub for bathing provides the best possible cleaning after a messy diaper. Accordingly, there is a need for a means by which infants can be cleansed or cleaned at any location with the use of warm water in a manner that does not impact the back muscles of the care giver.

In the related art, several devices disclose the design and function of a fold-down, wall-mounted infant changing platform. These include U.S. Pat. No. 5,906,015, issued in the name of Hilger et al., U.S. Pat. No. D 326,384, issued in the name of Burt et al. and U.S. Pat. No. D 314,112, issued in the name of Dainty.

U.S. Pat. No. 5,299,336, issued in the name of Marteeny, describes a portable diaper changing station.

U.S. Pat. No. 4,712,258, issued in the name of Eves, discloses a baby changing mat with a raised sill and straps for holding the baby.

Several patents describe the design and function of a platform for a baby diaper changing station. These include U.S. Pat. No. 5,864,905, issued in the name of Helmsderfer et al., U.S. Pat. No. 5,802,647, issued in the name of Helmsderfer et al., U.S. Pat. No. 5,754,999, issued in the name of Helmsderfer et al. and U.S. Pat. No. D 408,190, issued in the name of Helmsderfer et al.

U.S. Pat. No. 4,522,381, issued in the name of Ludwick discloses a one-piece sanitary diaper changing station.

A search of the prior art did not disclose any patents that anticipate directly many features of the instant invention. Consequently, a need has been felt for providing an apparatus and method which overcomes the problems cited above.

SUMMARY OF THE INVENTION

It is therefore an object of the present invention to provide an improved baby changing and washing station that allows an infant to be cleansed or cleaned at any location with the use of warm water in a manner that does not strain the back muscles of the care giver.

Briefly described according to one embodiment of the present invention, a baby changing and washing station is disclosed, designed as an apparatus to aid in the washing and/or cleansing of an infant. The present invention comprises a frame that is attached to a wall and provides for a fold down table portion, similar in design to a conventional diaper changing station. A padded vinyl area for the infant is provided along with restraining straps to hold the infant. A water bottle is provided in a heated container to allow the water to be slightly warmed. Tubing then carries the water through a release device at the end of the tube to allow cleansing of the infant after a diaper change or may be used to wash the entire infant. A drain system in the fold down table collects the waste water in a catch basin which may be removed and emptied after bathing duties are complete.

The present invention is intended for use in the home or public locations where a water supply is not readily available. The use of the present invention allows infants to be cleansed in a more complete manner which allows for increased health and sanitary conditions while providing for increased ease on care giver's part.

It is another object of the present invention to provide a device that secures a child while being cleaned.

It is another object of the present invention to provide a device that allows an infant to be cleaned with warm water in a quick and sanitary manner.

It is another object of the present invention to provide a device that can be used in both residential and commercial settings.

It is another object of the present invention to provide a device that allows a more thorough cleaning than tissues or baby wipes.

Other objects of the present invention include providing a device that has a small storage space requirement, cost effective and of stable construction.

DESCRIPTIVE KEY

| | | | |
|---|---|---|---|
| 10 | baby changing and washing station | 90 | restraining straps |
| 20 | frame | 100 | water supply means |
| 25 | wall | 110 | water reservoir |
| 30 | wall securement means | 120 | tubing |
| 40 | table portion | 130 | valve |
| 50 | indented portion | 140 | heating means |
| 60 | hole | 150 | water bottle |
| 70 | catch basin | 160 | heated container |
| 80 | padded area | 170 | electric heater |

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the FIGS. 1 through 6.

1. Detailed Description of the Figures

Figure 1:
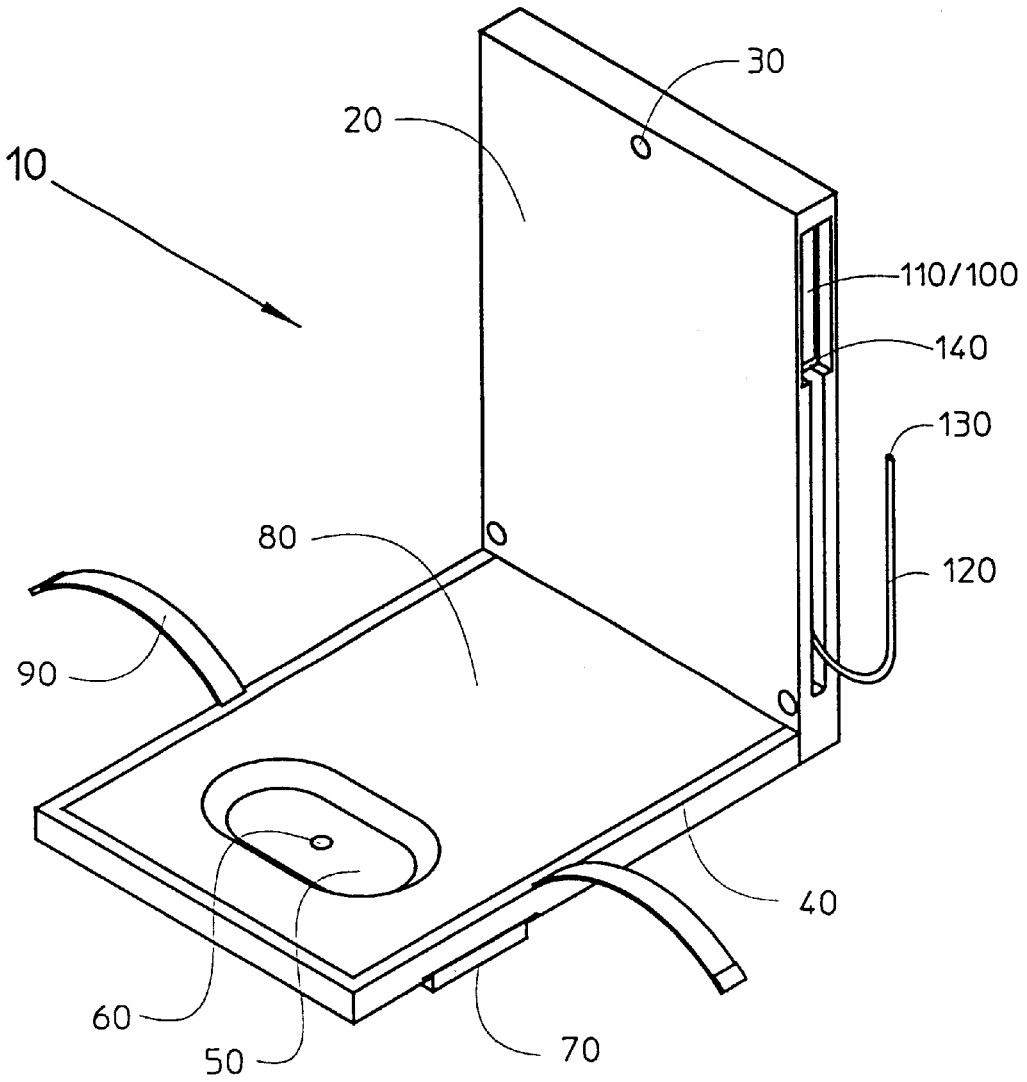
FIG. 1 is a perspective view of the preferred embodiment of baby changing and washing station 10.
Figure 2:
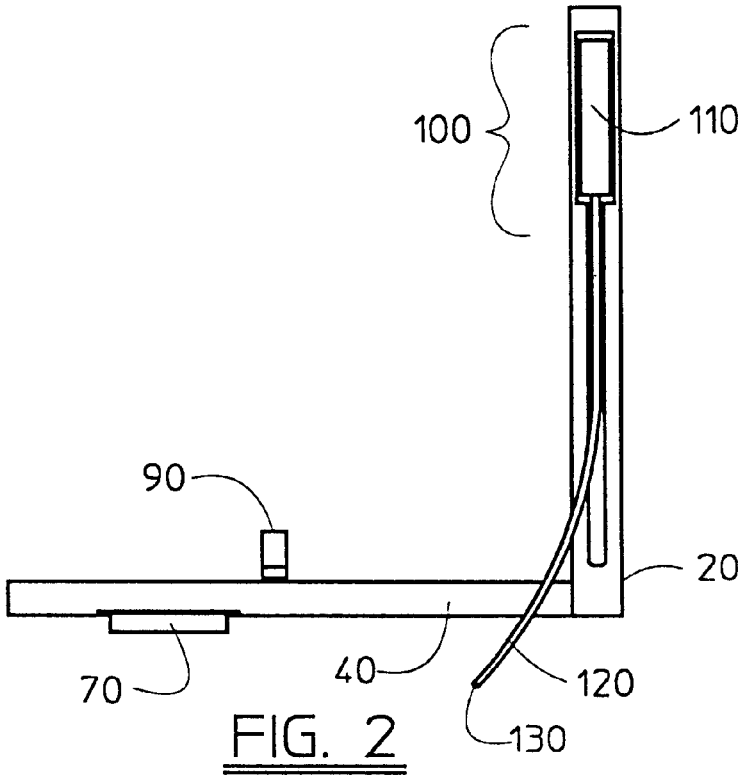
FIG. 2 is a right side view thereof.
Figure 3:
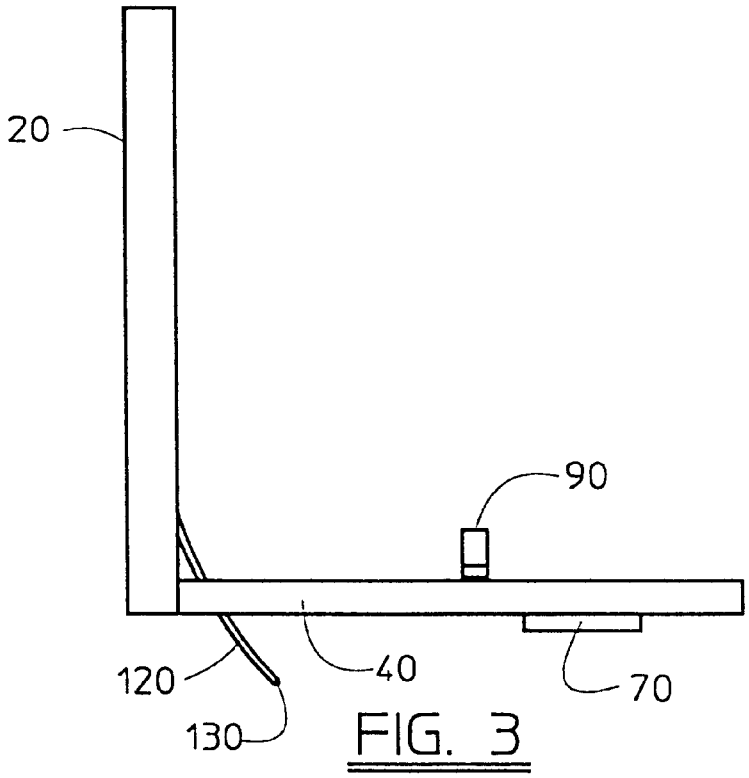
FIG. 3 is a left side view thereof.

Referring now to FIG. 1, a baby changing and washing station 10 is shown, according to the present invention, designed as an apparatus to aid in the washing and/or cleansing of an infant. The present invention comprises a frame 20. The frame 20 is designed to be attached to a wall 25 using wall securement means 30. For purposes of disclosure, the wall securement means 30 is depicted as wall screws.

Referring now to FIGS. 1 through 4, a fold down table portion 40, of a generally flat, rectangular configuration, similar in design to a conventional diaper changing station, attaches to the frame 20 and is designed to fold down into a generally horizontal plane. The table portion 40 has an indented portion 50 which is designed and configured to hold a baby's buttocks, thereby keeping water from spilling onto the table portion 40.

Figure 4:
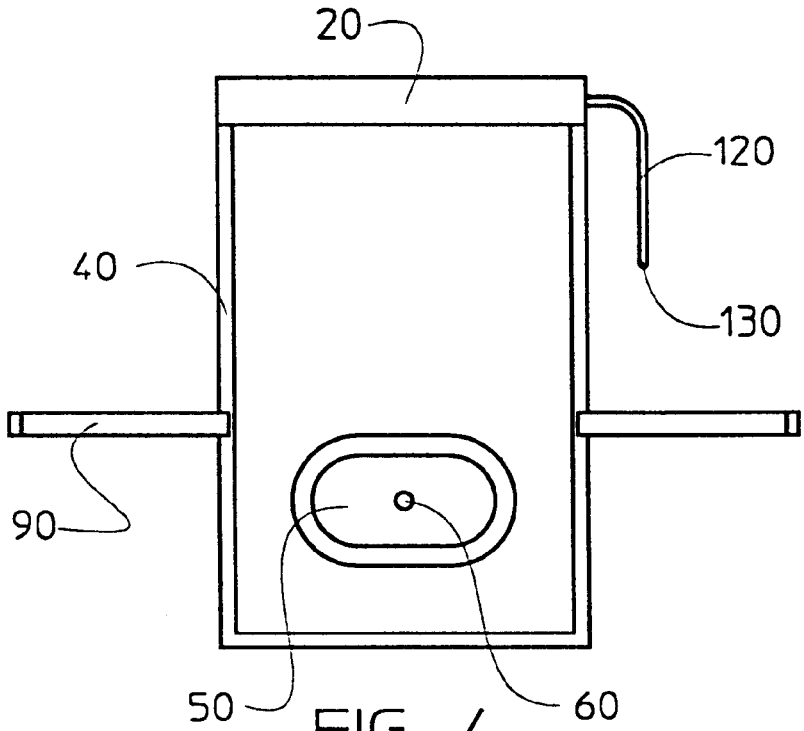
FIG. 4 is a top view thereof.
Figure 5:
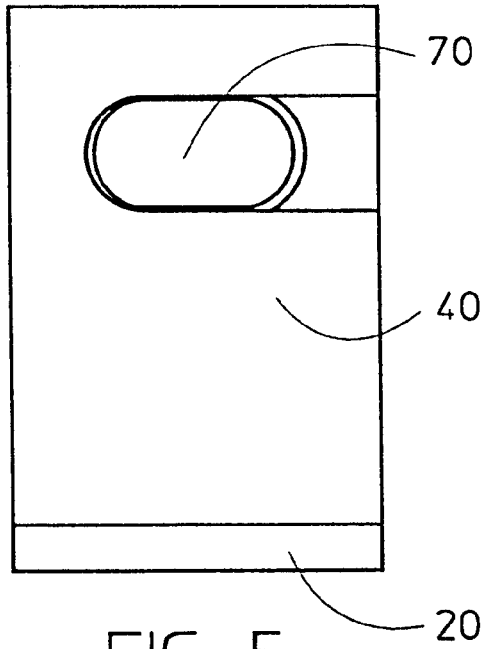
FIG. 5 is a front view of the preferred embodiment with the table portion in the up position.
Figure 6:
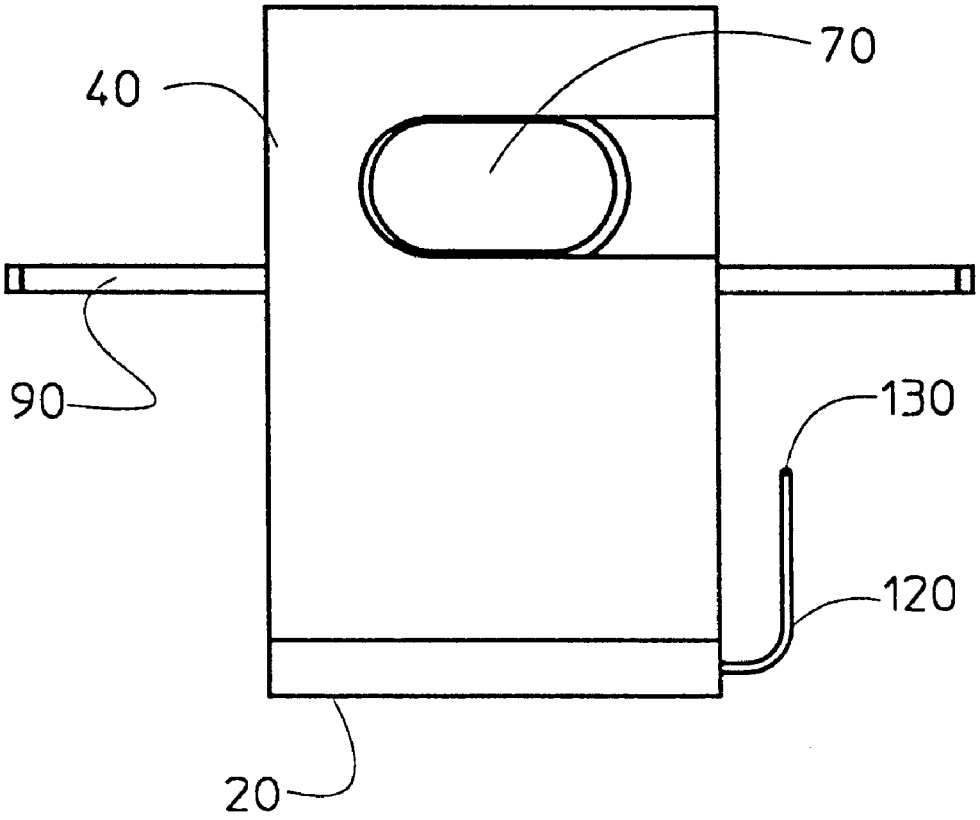
FIG. 6 is a bottom view of the preferred embodiment.

Referring now to FIG. 4, a hole 60 is located in the indented portion 50 so that water can drain out of the indented portion 50 and into a catch basin 70. The catch basin 70 is located beneath the table portion 40 and may be removed and emptied after bathing duties are complete.

Referring now to FIGS. 1 and 4, a padded area 80 is located on the top surface of the table portion 40. The padded area 80 is designed to provide comfort to the infant. The padded area 80 does not interfere with water drainage into the catch basin 70.

Referring now to FIGS. 1 through 4, restraining straps 90 are attached to table portion 40, and are designed to hold the infant. The restraining straps 90 are adjustable to fit infants of varying sizes.

Referring now to FIGS. 1, 2, 4, and 6, a water supply means 100 is provided for. The water supply means 100 is designed to provide heated water for use in washing the infant's bottom. In the preferred embodiment, the water supply means 100 is depicted as a water reservoir 110 with flexible tubing 120 running out of the water reservoir 110 and a valve 130 on the end of the tubing 120, opposite the water reservoir 110. Heating means 140 is used to heat the water. This allows the water to be slightly warmed.

The present invention is intended for use in the home or public locations where a water supply is not readily available. The use of the present invention allows infants to be cleansed in a more complete manner which allows for increased health and sanitary conditions while providing for increased ease on the care giver's part.

Figure 7:
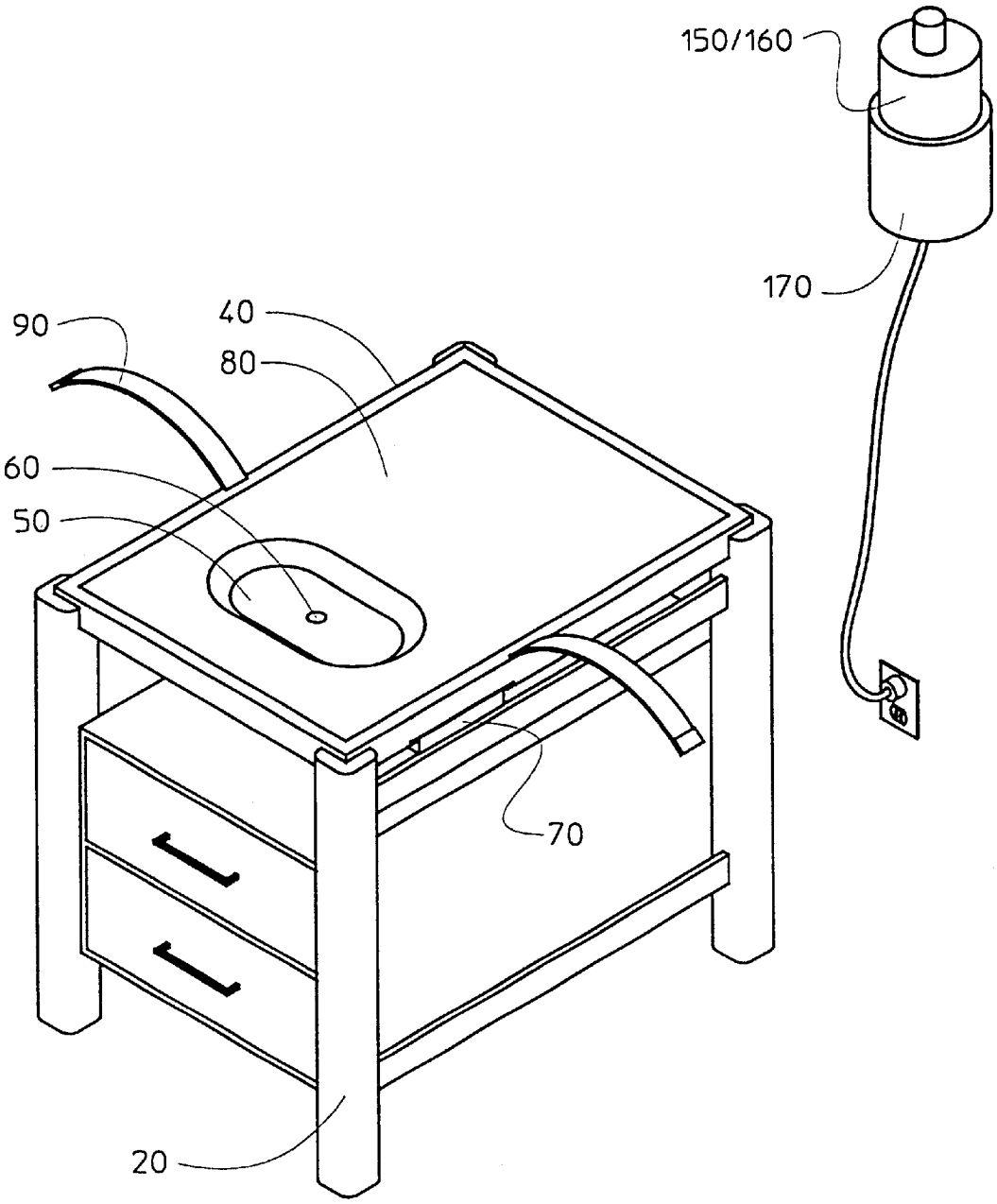
FIG. 7 is a perspective view of an alternate embodiment of the present invention.

Referring now to FIG. 7, in another embodiment of the present invention, the frame 20 and table portion 40 may be of a stand alone, nonfoldable, configuration, with the frame 20 not being attached to a wall 25. The water supply means 100 is depicted as a water bottle 150, releasably resting in a heated container 160. The heating means 140 is depicted as an electric heater 170 that plugs into an electrical outlet. The heating means 140 may also be battery operated. As such, the present invention would function as a table-type configuration.

It is envisioned that other styles and configurations of the present invention can be easily incorporated into the teachings of the present invention, and only one particular configuration shall be shown and described for purposes of clarity and disclosure and not by way of limitation of scope.

2. Operation of the Preferred Embodiment

To use the present invention, fold down the table portion 40. Reveal the child's buttocks and place it in or near the indented portion 50 on the table portion 40. Secure the child with the restraining straps 90. Grab the tubing 120 and open the valve 130, thereby washing the child's buttocks. When finished, wipe the child's buttocks with a towel and reclothe the child. Next, dispose of the water in the catch basin 70 and put the catch basin 70 back in place.

Figure 8:
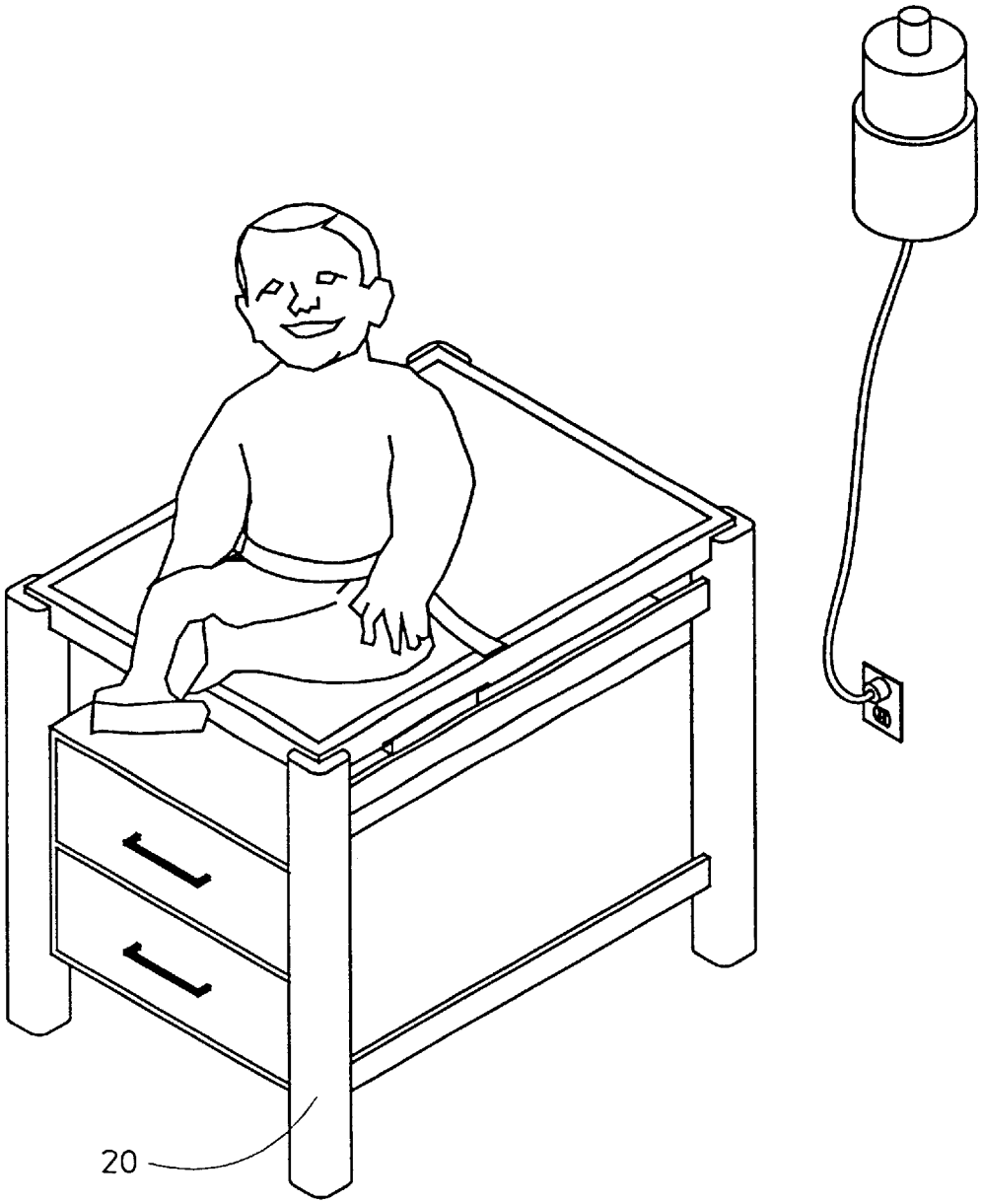
FIG. 8 is an in-use view of the alternate embodiment of the present invention.

Referring now to FIG. 8, the procedure for use of the alternate embodiment is similar, except that the water bottle 150 is used instead of the tubing 120 and valve 130, and there is no need to fold down the table portion 40, since it is already in the horizontal plane.

The foregoing description is included to illustrate the operation of the preferred embodiment and is not meant to limit the scope of the invention. The scope of the invention is to be limited only by the following claims.

What is claimed is:

1. A baby changing and washing station comprising:

a frame, said frame designed to be attached to a wall;

wall securement means, said wall securement means designed to secure said frame to said wall;

a table portion, said table portion being of a generally flat, rectangular configuration, similar in design to a conventional diaper changing station, said table portion attached to said frame and designed to fold down into a generally horizontal plane;

an indented portion, said indented portion located on said table portion, said indented portion configured and designed to hold a baby's buttocks, thereby keeping water from spilling onto the table portion;

a hole, said hole located in said indented portion so that water can drain out of said indented portion;

a catch basin, said catch basin located beneath said table portion, said catch basin designed to receive liquid from said indented portion through said hole, said catch basin capable of being removed;

restraining straps, said restraining straps attached to said table portion, and designed to releasably secure an infant; and water supply means, said water supply means designed to provide warm water to wash a baby's buttocks.

2. The baby changing and washing station described in claim 1, wherein said water supply further comprises:

a water reservoir, said water reservoir designed to hold water;

flexible tubing, said tubing running out of said water reservoir; and a valve, said valve located on the end of said tube, opposite said water reservoir;

heating means, said heating means designed to warm the water in said water reservoir.

3. The baby changing and washing station described in claim 1, wherein said restraining straps are adjustable.

4. The baby changing and washing station described in claim 1, wherein said baby changing and washing station further comprises a padded area, said padded area located on the top surface of said table portion.

* * * * *